United States Patent [19]

Takahashi et al.

[11] Patent Number: 4,511,269

[45] Date of Patent: Apr. 16, 1985

[54] CANCEL TYPE PRINTING HEAD

[75] Inventors: Kazue Takahashi; Kenzi Okuna; Isao Nakajima, all of Ibaraki; Mineo Harada, Owariasahi; Yutaka Kako, Kasugai, all of Japan

[73] Assignee: Hitachi, Ltd., Tokyo, Japan

[21] Appl. No.: 480,788

[22] Filed: Mar. 31, 1983

[30] Foreign Application Priority Data

Apr. 12, 1982 [JP] Japan ..... 57-59519

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 3,991,869 11/1976 Berrey ..... 400/124

4,368,353 1/1983 Ando et al. ..... 400/124 X

FOREIGN PATENT DOCUMENTS 36466 3/1983 Japan ..... 400/124

OTHER PUBLICATIONS

*IBM Tech. Disc. Bulletin,* Lisinski, vol. 21, No. 1, Jun. 1978, p. 18, 400–124.

*Primary Examiner*—Paul T. Sewell

*Attorney, Agent, or Firm*—Antonelli, Terry & Wands

[57] ABSTRACT

A printing head is disclosed in which each attraction member is driven by a magnetic attraction and an impact printing operation is carried out by a strain energy caused by a displacement of a spring member provided on the attraction member. The fulcrum of rotation of the attraction member is defined between the attraction member and a magnetic polar face of a yoke constituting a magnetic circuit together with the attraction member. Means for adjusting the resilient force of the spring member is engaged with a free end of the spring member.

7 Claims, 16 Drawing Figures

CANCEL TYPE PRINTING HEAD

BACKGROUND OF THE INVENTION

The present invention relates to a printing head of an impact type printer. More particularly, it is concerned with a printing head of a cancel type printer wherein a strain energy stored by an attraction of a permanent magnet is released to an attraction member by a cancellation thereof.

Printing heads for impact type printers are of the so-called magnetic drive type in which an attraction member is accelerated for printing operations by attraction of an electromagnet or of the so-called cancel type in which a spring member is displaced by attraction of a permanent magnet to thereby impart a strain energy to the spring member so that the attraction of the permanent magnet is cancelled by magnetic flux of the electromagnet for the printing operation.

Since the above described cancel type printing head possesses various advantages over the magnetic drive type printing head, various kinds of cancel type printing heads are widely used at present.

In such a type of printing head, the printing wire or the attraction member coupled thereto is moved by the strain energy stored by the displacement of the spring member. In other words, the resilient force of the spring member is directly used as a printing energy of the printing wire so that the printing quality depends mainly on variation of the resilient force of the spring member with respect to a set value.

However, in the conventional cancel type printing heads, one end of the spring member is fixedly secured to the head body or the like. For this reason, the resilient force of the spring member must be adjusted by the magnetic flux of the permanent magnet or the exerted magnetic force of the electromagnet or a machining allowance of the spring member must be strictly limited. This is disadvantageous in that it is very difficult to manage the production process of the spring member, thereby maintaining a satisfactory mechanical allowance and to adjust the spring force of the spring member.

SUMMARY OF THE INVENTION

An object of the invention is to provide a printing head in which a resilient force of a spring member may readily be controlled or adjusted.

Another object of the invention is to provide a printing head enabling an improvement in printing quality.

Still another object of the invention is to provide a printing head which can be manufactured with high efficiency.

Still another object of the invention is to provide a printing head which enables a speedup of the printing operation.

These objects may be achieved by providing a printing head comprising lever components each having printing wires and driving mechanisms for the lever components, each of the lever components driven by the driving mechanisms including a lever body connected to the associated printing wire, an attraction member provided at one end the lever body and adapted to be attractively moved by a magnetic attraction of a permanent magnet interposed between yokes constituting the driving mechanisms, and means for adjusting a resilient force of the spring member, the means being engaged with a free end of the spring member, wherein a fulcrum of rotation for the lever component is formed between the attraction member and a magnetic polar face of the yoke confronted with the attraction member.

Other objects and advantages of the present invention will be more clearly understood by referring to the following descriptions of the specific embodiments and the accompanying drawings.

DESCRIPTION OF THE PREFERRED EMBODIMENTS

The present invention will now be described by way of examples with reference to the accompanying drawings.

Figure 1:
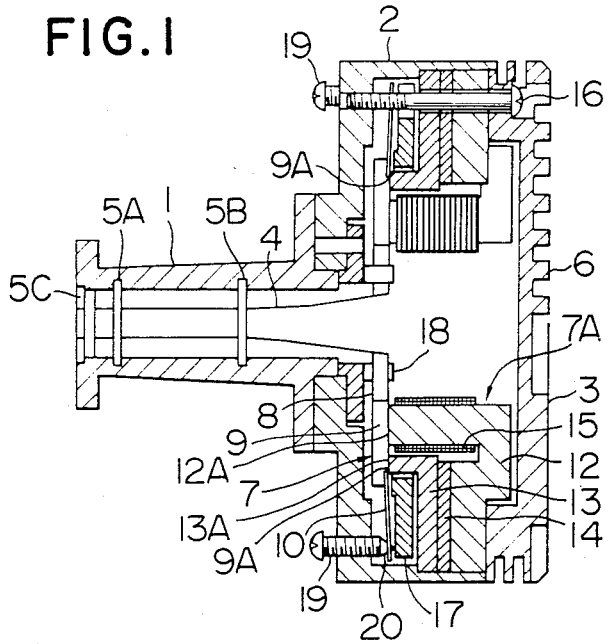
FIG. 1 is a cross-sectional view of an embodiment of a printing head according to the present invention.
Figure 2:
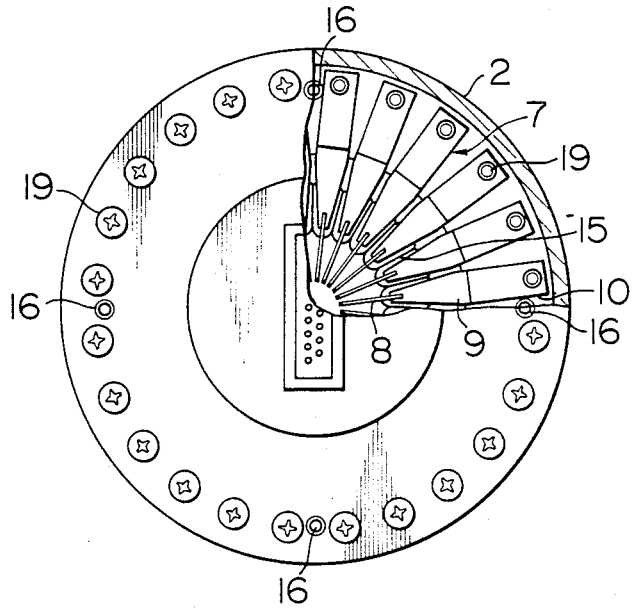
FIG. 2 is a fragmentary cross-sectional front view of the printing head shown in FIG. 1.

FIGS. 1 and 2 show a printing head embodying the invention. As shown in FIGS. 1 and 2, the printing head according to the invention is constituted by an outer frame structure including a guide frame 1, a head frame 2 and an outer plate 3. The guide frame 1 is provided with a guide 5A and a center guide 5B for printing wires 4 and a wire bearing 5C. On an outer periphery of the outer plate 3, there are formed a number of projections 6 in order to enhance a heat radiation effect.

Figure 3:
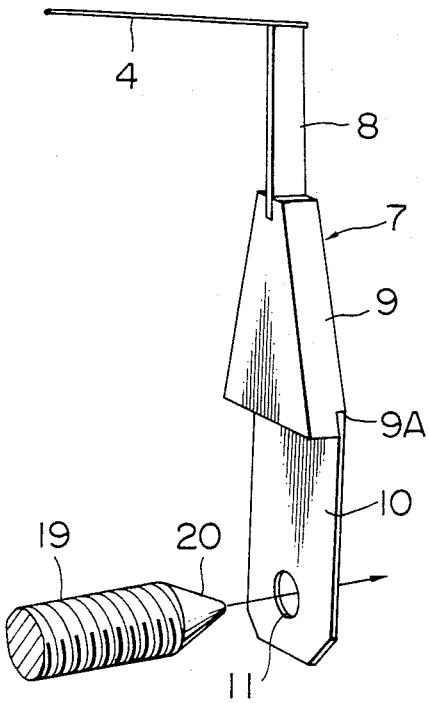
FIG. 3 is a perspective view showing a lever component constituting a part of the printing head according to the invention.

In a spacing defined by the head frame 2 and the outer plate 3, there are provided a number of lever components 7 each connected to the printing wires 4 and a drive mechanism 7A for the lever components 7. As shown in FIG. 2, a number of lever components 7 each extend radially outwardly and are angularly arranged along with a circumference of the head frame 2. As shown in FIG. 3, each of the lever components 7 is made up of a lever body 8, an attraction member 9 and a spring member 10. The lever body 8 is connected at its free end to the printing wire 4. The attraction member 9 is made of material having a high magnetic permeability and is coupled at one end to the lever body 8 and at the other end to the plate-like spring member 10. At the opposite end of the spring member 10, there is formed an opening in the form of a hole 11 which is to be used for adjusting its resiliency.

Referring back to FIG. 1, the drive mechanism 7A for the lever components 7 is constructed so as to include a first yoke 12, a second yoke 13, a permanent magnet 14 interposed between the first and second yokes 12 and 13 and a coil 15 provided on the first yoke 12. The second yoke 13 has a magnetic polar face 13A disposed in the vicinity of a magnetic polar face 12A of the first yoke 12. These magnetic polar faces 13A and 12A are confronted with the associated attraction member 9. The first and second yokes 12 and 13, the permanent magnet 14 and the attraction member 9 constitute together a magnetic circuit for the permanent magnet 14 and the coil 15. The permanent magnet 14 will generate a magnetic flux for attracting the attraction member 9 toward the yokes. The coil 15 is set to cancel or offset the magnetic flux of the permanent magnet 14 by its magnetic energy.

The first yoke 12, the second yoke 13, the permanent magnet 14 and the outer plate 3 are tightly fastened together by screws 16. The lever components 7 are usually attracted onto the magnetic polar faces 12A and 13A of the first nd second yokes 12 and 13 so that the components 7 are psitioned on the front end faces of the yokes 12 and 13.The fulcrum of rotation of each lever component 7 is the adacent face 13A of the second yoke 13 and an edge prtion **9*a* of the attraction member 9 which is brougt into contact with the polar face 13A. A support 17 is provided on a side of the guide frame 1 at the second yoke 13. Upon the rotation of the lever components 7, the head frame 2 is provided with a lever guide 18 for guiding the lever bodies 8 of the lever components 7 in order to prevent lateral vibrations of the lever components 7**.

Figure 4:
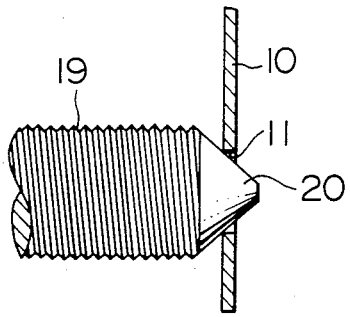
FIGS. 4 through 11 are cross-sectional side views showing various embodiments of engagement structures of spring members and insert members of spring force adjusting means used in the printing head according to the invention.

The means for adjusting the resilient force of the spring member 10 is provided with insert members 19 which are threadedly engaged into the head frame 2. Each of the insert members 19 has a tapered portion 20 at its distal end. As shown in FIG. 4, the tapered portion 20 is engaged with the hole 11 formed at the end portion of the spring member 10. The insertion or retraction of the insert member 19 allows the spring member 10 to be displaced, thereby enabling the adjustment of the resilient force of the spring member 10.

The thus constructed printing head in the embodiment of the invention will operate as follows.

Before the commencement of printing, as shown in FIG. 1, the attraction members 9 are attracted onto the magnetic polar surfaces 12A and 13A of the first and second yokes 12 and 13 by the magnetic attraction of the permanent magnet 14. At this instance, the spring members 10 are displaced to accumlate therein strain or deformation energy. The magnitude of the resiliency due to this deformation energy may be adjusted by the insertion or retraction of the inserts 19.

Subsequently, when a current is applied to the coil 15, since the magnetic flux of the permanent magnet 14 is cancelled, the attraction member 9 is rotated by the spring force of the spring member 10 around the fulcrum of rotation defined by the magnetic polar face 13A and the edge portion 9A of the attraction member 9. Accordingly, the printing wire 4 is guided by the guide 5A and the center guide 5B so that its end strikes a platen through an ink ribbon and a printing paper. As a result, a dot forming a letter is printed on the printing paper.

In the above described printing operation, the fulcrum of rotation of the lever component 7 is the edge portion 9A of the attraction member 9 as described before. For this reason, a radius of rotation of the lever component 7 is equal to a length between the edge portion 9A and the connecting portion of the printing wire 4 to the lever body 8. The radius of rotation of lever component 7 is smaller than that of the conventional printing head in which one end of the spring member is fixed to the head body or the like as explained in the background of the invention. This makes it possible to reduce an inertia moment of the lever component 7 and to operate the lever component at a higher speed.

Also, in the conventional printing head as explained before, since the spring member would be bent like an S letter in accordance with some kind of motion of the lever component, a large stress tends to be generated in the spring member. In contrast, according to the present invention, since the fulcrum of rotation of the lever component 7 is located at the edge portion 9A of the attraction member 9 and the free end of the spring member 10 is pressed by the insert 19, the spring member 10 acts as a cantilever. Accordingly, a stress not greater than necessary is applied to the spring member 10 according to the present invention, thereby providing a long service life.

Figure 5:
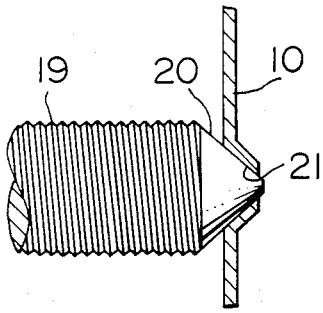
Figure 6:
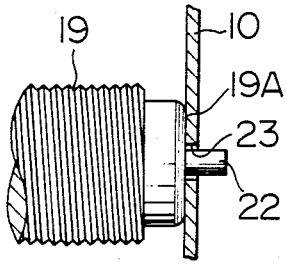

In the above described embodiment, the coupling between the insert member 19 and the spring member 10 is carried out by inserting the tapered portion 20, formed at the end portion of the insert 19, into the hole 11 formed at the end portion of the spring member 10. However, as shown in FIG. 5, a tapered hole 21 may be formed at the end portion of the spring member 10 and the tapered portion 20 of the insert member 19 may be inserted into this tapered hole 21 in contact therewith. Alternately, as shown in FIG. 6, a shaft member 22 having a small diameter may be formed at the end of the insert 19 and this shaft member 22 may be inserted into a hole 23 formed at the end portion of the spring member 10 while a back surface 19A of the insert member 19 is brought into contact with the spring member 10. With such a construction, since the shaft member 22 and the hole 23 serve to guide and hold the lever component 7, the location of the fulcrum of rotation of the lever component 7 and the attraction member 9 may be ensured.

Figure 7:
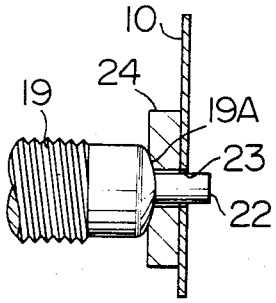
Figure 8:
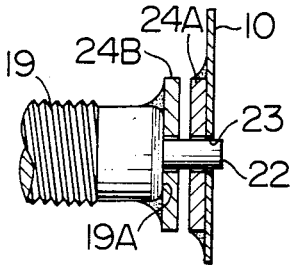

With the thus constructed coupling structure between the insert member 19 and the spring member 10, the resilient force of the spring member 10 may be sufficiently adjusted and simultaneously therewith, the location of the lever component 7 may be ensured. However, upon the printing operation, the resilient force of the spring member 10 is varied so that its bend curve is also varied. As a result, a relative slippage would be generated between the spring member 10 and the back surface 19A of the insert member 19 which is in contact with the spring member 10, resulting in abrasion of the contact surfaces thereof. If the abrasion would be remarkable, the resilient force would be decreased. In order to reduce such abrasion of the contact surfaces, it is available, as shown in FIG. 7, to interpose a friction-resistive member 24 between the spring member 10 and the back surface 19A of the insert member 19 or otherwise, as shown in FIG. 8, to fixedly secure friction-resistive members 24A and 24B to the spring member 10 and the back surface 19A of the insert 19, respectively.

Figure 9:
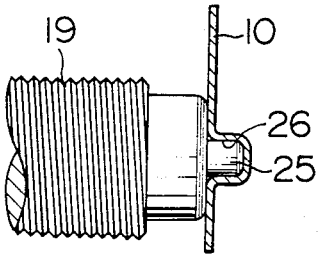
Figure 10:
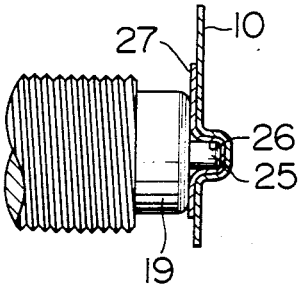
Figure 11:
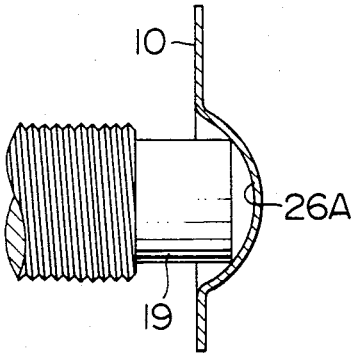

As another available coupling structure used for reducing the amount of abrasion of the coupling portion between the spring member 10 and the insert 19, as shown in FIG. 9, a projection 25 is formed at the end face of the insert 19 and the projection 25 may be inserted into an opening in the form of a recess portion 26 formed at the end portion of the spring member 10. In the case where in the structure shown in FIG. 9, a reduction of the contact surfaces or a machining error thereof would be generated, it is available to provide a friction-resistive membrane 27 made of, for example, polyimide onto the contact portions, as shown in FIG. 10. Alternately, a recess portion 26A formed at the end portion of the spring member 10 may be made in a hemispherical shape as shown in FIG. 11 and the end portion of the insert 19 may be brought into partial contact with the hemispherical recess portion 26A. The above described insert 19 is provided with a screw thread but any equivalent structure may be used.

Figure 12:
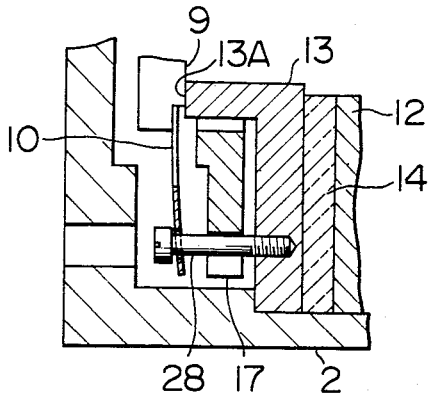
FIG. 12 is a cross-sectional side view of another embodiment of spring force adjusting means used in the printing embodiment of spring force adjusting means used in the printing head of the invention.

Also, in the above described embodiments, the spring force adjusting means for the spring member 10 is constructed so that the end portion of the spring member 10 may be inserted toward the yoke side by the insert member 19. However, as shown in FIG. 12, it is possible to modify the structure so that the end portion of the spring member 10 is retracted on the yoke side by the action of a screw-threaded member 28 for coupling the end portion of the spring member 10 and the second yoke 13 to each other.

Figure 13:
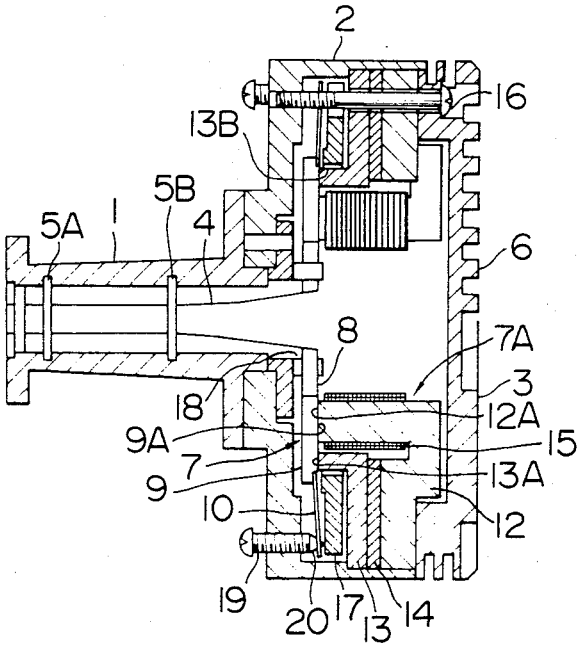
FIG. 13 is a cross-sectional view of another embodiment of a printing head according to the invention.

Also, in order to compensate for the change caused by the abrasion of the rotational fulcrum of the lever component 7, the edge portion 9A may be slightly rounded. Furthermore, the fulcrum of rotation of the lever component 7 may be formed by the edge portion of the magnetic polar face 13A and the back surface of the attraction member 9 as shown in FIG. 13.

Figure 14:
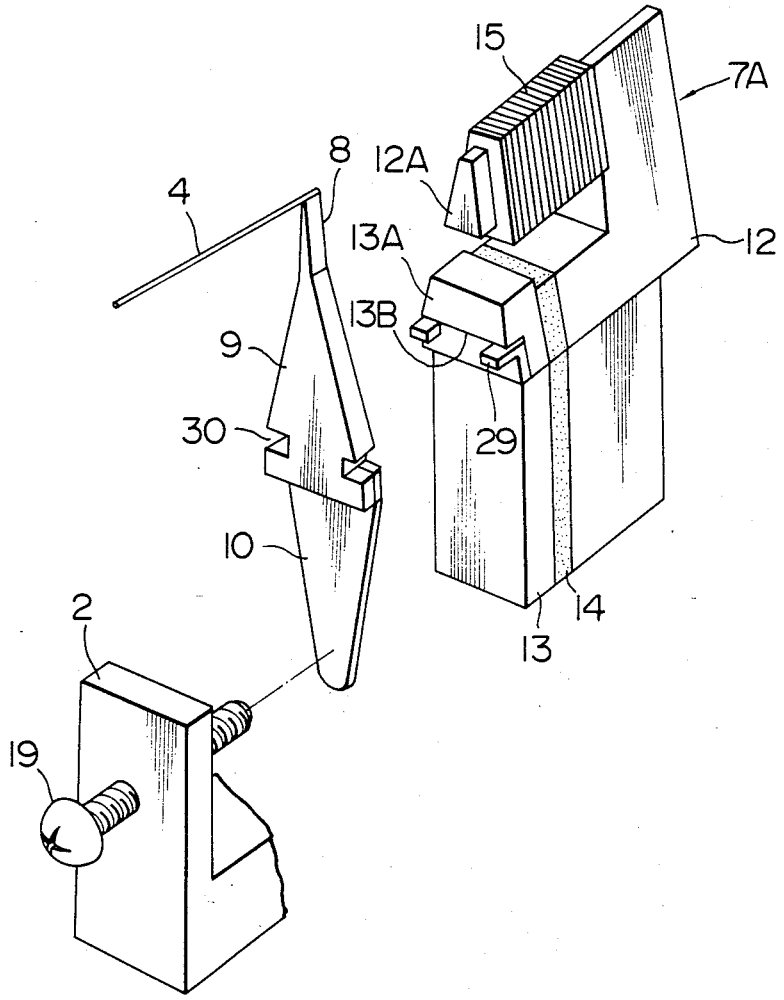
FIG. 14 is a perspective view of a support structure of a lever component used in the printing head according to the invention.
Figure 15:
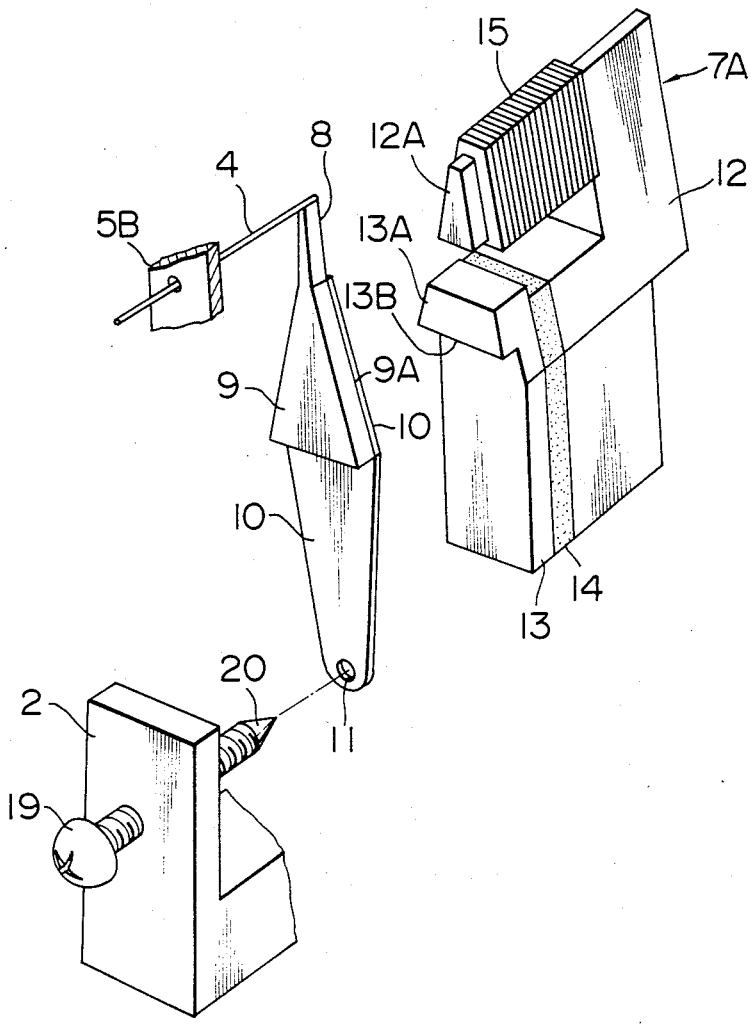
FIG. 15 is a perspective view of a mounting structure of a spring member used in the printing head according to the invention.
Figure 16:
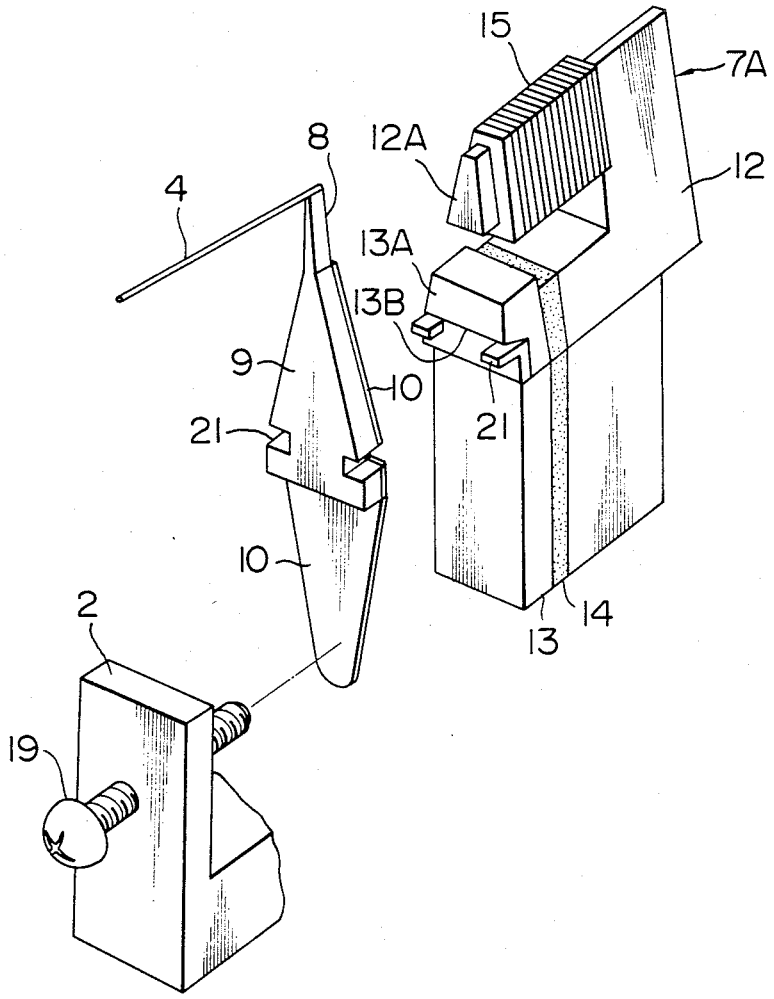
FIG. 16 is a perspective view of another mounting structure of a spring member used in the printing head according to the present invention.

In the foregoing embodiment, the support of each lever component 7 is attained also by the resilient force adjusting means. The present invention is, however, applicable to such a type that as shown in FIG. 14, the lever component 7 is supported by an engagement between hinge mechanisms 29 formed in the vicinity of the magnetic polar face 13A and cutaway portions 30 formed in the attraction member 9. In this case, the end of the insert 19 may be brought into contact with the end portion of the spring member 10. Furthermore, it is possible to provide the spring member 10 so as to extend along the magnetic attractive surface 9A of the attraction member 9 as shown in FIG. 15 or 16. A corner portion 13B of the magnetic polar face 13A which may be a fulcrum of rotation for the attraction member 9 may be bevelled into a slightly rounded corner to thereby enhance a frictional property.

As described above, according to the invention, since the adjustment and control of each spring member may readily be achieved, its printing quality may be enhanced and at the same time, a machining accuracy is not so restricted, which will lead to a remarkable improvement in manufacturing efficiency. Moreover, the fulcrum of rotation for the lever component may be positioned on the magnetic polar face of the yoke, so that the radius of rotation of the lever component is decreased, which will lead to a speedup of operation.

What is claimed is:

1. A printing head comprising lever components each having printing wires and driving mechanisms for said lever components, each of said lever components driven by said driving mechanisms including a lever body connected to the associated printing wire, an attraction member provided at one end of said lever body and adapted to be attractively moved by a magnetic attraction of a permanent magnet interposed between yokes constituting said driving mechanisms, a spring member coupled to said attraction member and having a free end portion adapted to be biased to create a resilient force therein for displacing the associated printing wire, means for adjusting a resilient force of said spring member, said means including an insert member which engages said free end portion of said spring member while being received in an opening of said free portion for displacing the free end portion of the spring member toward the yokes, and wherein a fulcrum of rotation for said lever component is formed between said attraction member and a magnetic polar face of a yoke confronted with said attraction member.

2. The printing head according to claim 1, wherein said fulcrum of rotation for said lever component is made by a contact between said magnetic polar face of the yoke and an edge portion on a spring member mounting side of said attraction member.

3. The printing head according to claim 1, wherein said fulcrum of rotation for said lever component is made by a contact between a magnetic attractive surface of said attraction member and an edge portion of a magnetic polar face of the yoke.

4. The printing head according to claim 1, wherein a tapered portion is formed at an end of said insert member and a hole is formed in said free end portion of said spring member as said opening whereby said tapered portion of said insert is inserted into said hole of said free end portion of said spring member.

5. The printing head according to claim 1, wherein a shaft member having a small diameter is formed at an end of said insert member and a hole is formed in said free end portion of said spring member as said opening whereby said shaft member is inserted into said hole of said free end portion of said spring member.

6. The printing head according to claim 5, wherein a frictionally resistive member is interposed between said insert member and said spring member.

7. The printing head according to claim 1, wherein a projection member is formed at an end of said insert member and a recess portion is formed in said free end portion of said spring member as said opening whereby said projection member is inserted into said recess portion of said free end portion of said spring member.

* * * * *